United States Patent [19]

Sevik

[11] Patent Number: 4,979,455

[45] Date of Patent: Dec. 25, 1990

[54] CONTROL SURFACES

[75] Inventor: Maurice M. Sevik, Centre County, Pa.

[73] Assignee: The United States of America as represented by the Secretary of the Navy, Washington, D.C.

[21] Appl. No.: 8,159

[22] Filed: Jan. 19, 1970

[51] Int. Cl.[5] ..... B63G 8/20; B63H 1/28; B63H 5/00

[52] U.S. Cl. ..... 114/332; 114/57; 114/163; 114/338; 440/66

[58] Field of Search ..... 114/16 R, 66.5 H, 56, 114/57, 274, 332, 338, 163; 440/66

[56] References Cited

U.S. PATENT DOCUMENTS 3,063,397 11/1962 Boericke, Jr. ..... 114/57

*Primary Examiner*—David H. Brown

*Attorney, Agent, or Firm*—James V. Tura; James B. Bechtel; Susan E. Verona

[57] ABSTRACT

A control surface design for submerged vehicles. The control surfaces are movably mounted or radially extending support members such that the wake created by the deflection of the control surfaces will not be transmitted to the propeller. The support members have a cross section that minimizes flow disturbances in the region of the propeller.

6 Claims, No Drawings

CONTROL SURFACES

STATEMENT OF GOVERNMENT INTEREST

The invention described herein may be manufactured and used by or for the Government of the United States of Amnerica for gevernmental purposes without the payment of any royalties thereon or therefor.

BACKGROUND OF THE INVENTION

This invention relates generally to submerged vehicles and more particularly to improved control surfaces and control surface support members for such vehicles.

The propellers of submerged vehicles are usually positioned so as to operate in a highly disturbed flow emvironment. This leads to fluctuations in the forces and moments exerted by the propellers and increases the vibration level of the hull.

OBJECTS OF THE INVENTION

Accordingly, it is an object of this invention to reduce the disturbance of the flow environment in the region of the propeller disc.

Another object of this invention is to reduce the acoustic noise radiation from submarines by reducing hull vibration.

A further object is the provision of control surfaces whose wakes do not penetrate the propeller disc.

Still another object is to provide supports for the control surfaces whose contribution to flow disturbances is minimal.

Other objects, advantages and novel features of the invention will become apparent from the following detailed description of the invention when considered in conjunction with the accompanying drawings.

DESCRIPTION OF THE PREFERRED EMBODIMENTS

Figure 1:
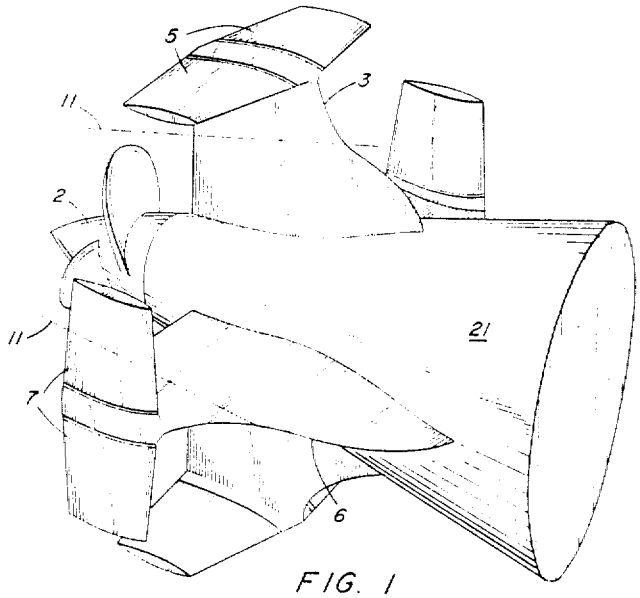
FIG. 1 is a perspective view of the aft end of an underwater vehicle showing a preferred embodiment of the invention.

FIG. 1, which illustrates a preferred embodiment of the invention shows the aft end of a vehicle body 21 having mounted thereon two fixed elevator support members 3 and two fixed rudder support members 6. The elevator support members 3 are shorter in dimension along the vehicle surface generally parallel to the vehicle axis than are the rudder support mebers 6. At the radial extremity of the support members 3 and 6, and at right angles thereto, are mounted movable elevator control surfaces 5 and movable rudder control surfaces 7, respectively.

Figure 2:
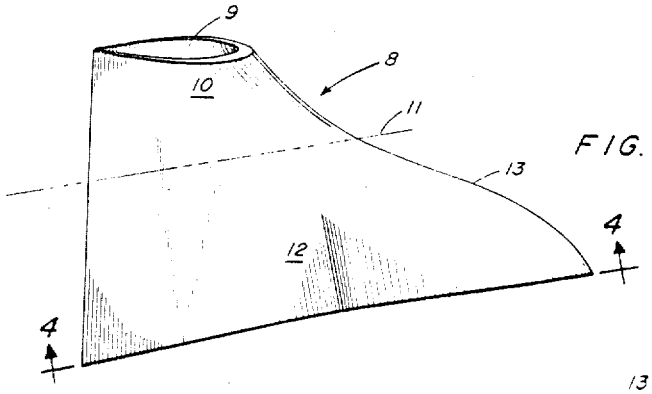
FIG. 2 is a side view of the support and control surface members.

Referring now to FIGS. 2 and/or 3, there is shown a fixed support member 8 typical of elevator support member 3 and rudder support member 6. The leading edge 13 of support member 8 has a swept leading edge configuration and is sharp in the radially inner zone.

This sharpness and swept leading edge configuration combine to prevent flow in the direction of and parallel to the leading edge, and also minimize flow disturbances arising from interactions between the support members and the vehicle body 21.

Figure 4:
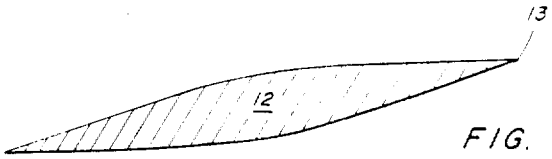
FIG. 4 is a section of the support member taken along line 4—4 of FIG. 2.
Figure 3:
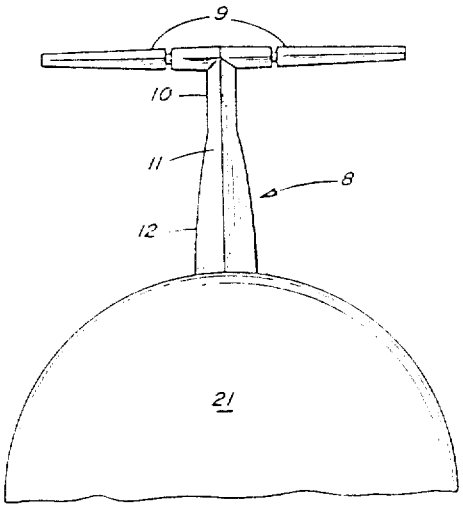
FIG. 3 is a front view of the support and control surface members.

Fixed support member 8 has a varied cross-section that may be characterized as comprising three zones. In the zone 12 radially closest to the vehicle body 21, fixed support member 8 has a configuration symmetrical about a transverse axis and having sharp leading and trailing edges. This knife-edged zone 12 is shown in section in FIG. 4.

The zone radially furthest from vehicle body 21 is of airfoil configuration (i.e. rounded leading edge and sharp trailing edge) and is designated by reference numeral 10. Reference numeral 11 designates a transition zone between bicusped zone 12 and airfoil zone 10.

The configuration of zone 12 is such that it leaves a minimum disturbance behind it as it moves through a fluid. Thus, flow, disturbances in the region of propeller disc 2 are minimized by the use of such a configuration.

The extent of zone 12 depends on the flow characteristics of the vehicle body, and will extend to the point where the velocity of the retarded fluid flow adjacent to the vehicle body 21 has reached a substantial fraction of the free stream velocity value, such as 90%, but not less than 75%. The remainder may be of airfoil configuration with an intermediate transition zone to connect the other two zones in faired contours.

Movable control surfaces 9 are mounted at the radial extremity of fixed support 8. The particular cross-section of the control surfaces forms no part of this invention and they may be of conventional design.

With any design, deflection of the control surfaces creates a turbulent wake. The control surfaces of the instant invention are positioned to minimize control surface wake effects on propeller disc 2.

This is accomplished by extending airfoil portion 10 at least to the point necessary to prevent any wakes, created by control surface deflection, from penetrating propeller disc 2.

With the elimination of control surface wake effects, and a minimization of flow disturbances caused by the control surface supports, the total fluid disturbance in the propeller disc region is greatly reduced. This minimizes the fluctuating forces created by the interaction of the total fliuid disturbance and propeller rotation. Accordingly, the fluctuations in the forces and moments exerted by the propeller are reduced with an accompanying reduction in the vibration levels of the vehicle hull.

Figure 5:
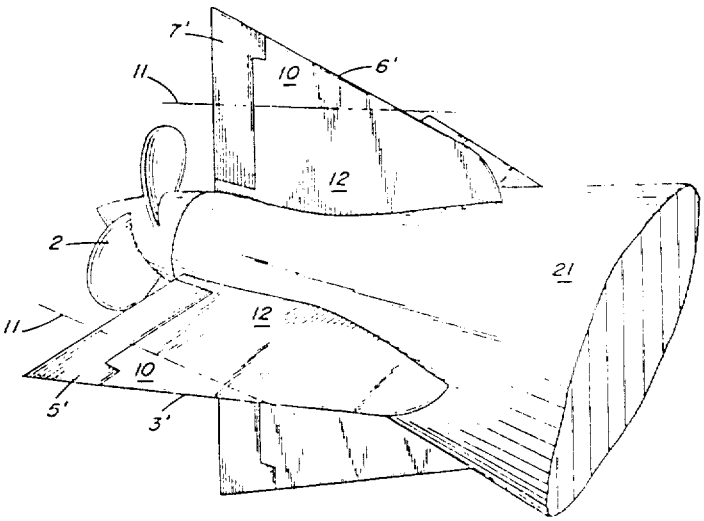
FIG. 5 is a perspective view of the aft end of an underwater vehicle showing another embodiment of the invention.

FIG. 5 shows another embodiment of the invention utilizing many of the principles contained in the embodiment of FIG. 1. Here, the control surfaces 7' are not mounted at right angles atop the supporting structures but, are instead, faired into the support contour itself.

Each of the four supports have a varying cross-sectional configuration similar to that described above including zones 10, 11 and 12. The use of knife-edged zone 12, extending to the point where the velocity of the retarded fluid flow adjacent to the vehicle body 21 has reached a substantial fraction of the free stream velocity value, again minimizes the flow disturbances caused by the control surface supporting structure. When the control surfaces are in an undeflected position the total fluid disturbances are reduced to the level obtainable in the embodiment of FIG. 1. However, when the control surfaces are deflected, the wakes created may penetrate propeller disc 2.

Since the fabrication problems of the embodiment of FIG. 5 are simpler than those of FIG. 1, specific vehicles, not warranting the more sophisticated design of FIG. 1, may still utilized many of the same principles in a manner similar to that shown in FIG. 5.

With obvious modifications, the same principles may be applied to control surfaces for surface ships. Also, as shown by the embodiment of FIG. 5, many modifications and variations of the present invention are possible.

What is claimed is:

1. In combination, a plurality of movable control surfaces mounted on the aft end of a vehicle body by a plurality of fixed support members, the improvement which comprises:

a first zone in the support member radially closest to the vehicle body of knife-edged configuration;

a seond zone in the support member of airfoil configuration; and a third zone in the support member, intermediate the first and second zones, to connect said first an second zones in faired contours.

2. The combination according to claim 1 in which the leading edge of each of the support members has a swept configuration.

3. The combination according to claim 1 wherein some of the support members are shorter in dimension along the vehicle surface, generally parallel to the vehicle axis, than others of the support members.

4. The combination according to claim 1 wherein the control surfaces are supported atop, and at right angles to, the support members.

5. The combination according to claim 1 wherein the control surfaces are faired into the support member contour.

6. The combination according to claim 1 wherein the first zone extends to at least the point where the velocity of the retarded fluid flow adjacent to the vehicle body has reached a substantial fraction of the free stream velocity value.

* * * * *

UNITED STATES PATENT AND TRADEMARK OFFICE

CERTIFICATE OF CORRECTION

PATENT NO. : 4,979,455

DATED : December 25, 1990

INVENTOR(S) : Maurice M. Sevik

It is certified that error appears in the above-identified patent and that said Letters Patent is hereby corrected as shown below:

The title page should be deleted to appear as per attached title page.

The sheets of drawings Consisting of Figures 1-5 should be added as shown on the attached sheets.

Signed and Sealed this

Twenty-first Day of July, 1992

*Attest:*

DOUGLAS B. COMER

*Attesting Officer*

*Acting Commissioner of Patents and Trademarks*

United States Patent [19]

Sevik

[11] Patent Number: 4,979,455

[45] Date of Patent: Dec. 25, 1990

[54] CONTROL SURFACES

[75] Inventor: Maurice M. Sevik, Centre County, Pa.

[73] Assignee: The United States of America as represented by the Secretary of the Navy, Washington, D.C.

[21] Appl. No.: 8,159

[22] Filed: Jan. 19, 1970

[51] Int. Cl.[5] ..... B63G 8/20; B63H 1/28; B63H 5/00

[52] U.S. Cl. ..... 114/332; 114/57; 114/163; 114/338; 440/66

[58] Field of Search ..... 114/16 R, 66.5 H, 56, 114/57, 274, 332, 338, 163; 440/66

[56] References Cited

U.S. PATENT DOCUMENTS 3,063,397 11/1962 Boericke, Jr. ..... 114/57

*Primary Examiner*—David H. Brown

*Attorney, Agent, or Firm*—James V. Tura; James B. Bechtel; Susan E. Verona

[57] ABSTRACT

A control surface design for submerged vehicles. The control surfaces are movably mounted or radially extending support members such that the wake created by the deflection of the control surfaces will not be transmitted to the propeller. The support members have a cross section that minimizes flow disturbances in the region of the propeller.

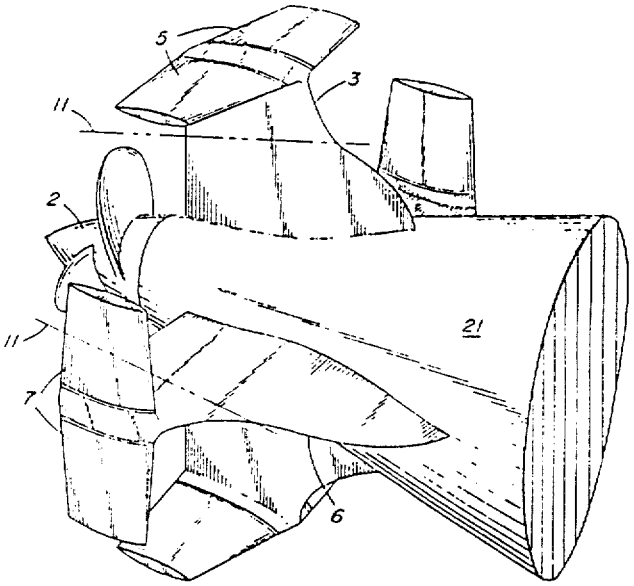

6 Claims, 2 Drawing sheets